United States Patent [19]

Kapke

[11] Patent Number: 4,887,719

[45] Date of Patent: Dec. 19, 1989

[54] MATERIAL ENGAGING AND SECURING DEVICE

[75] Inventor: Milton W. Kapke, Golden, Colo.

[73] Assignee: Goldco Industries, Inc., Loveland, Colo.

[21] Appl. No.: 194,426

[22] Filed: May 13, 1988

Related U.S. Application Data

[62] Division of Ser. No. 943,741, Dec. 19, 1986, Pat. No. 4,747,252.

[51] Int. Cl.[4] ..... B65D 19/00

[52] U.S. Cl. ..... 206/597; 206/526; 53/556; 53/461; 24/DIG. 22

[58] Field of Search ..... 206/597, 526; 53/556, 53/399, 211, 581, 461; 24/DIG. 22, 1

[56] References Cited

U.S. PATENT DOCUMENTS

| | | | |
|---|---|---|---|
| 4,332,326 | 6/1982 | Kelly et al. | 206/597 |
| 4,741,442 | 5/1988 | Slocomb | 53/461 |

FOREIGN PATENT DOCUMENTS

| | | |
|---|---|---|
| 2923714 | 6/1978 | Fed. Rep. of Germany . |
| 2841303 | 4/1980 | Fed. Rep. of Germany . |
| 3100623 | 9/1982 | Fed. Rep. of Germany . |

*Primary Examiner*—Joseph Man-Fu Moy
*Attorney, Agent, or Firm*—Robert E. Harris

[57] ABSTRACT

A material positioning and securing apparatus and process is disclosed that is particularly useful in association with a device for spirally wrapping palletized units at a wrapping station with a stretchable netting material to form a secure package. A disposable elongated material engaging member, formed from reasonably stiff and yet deformable material, is placed adjacent one side of units on a pallet at the wrapping station with the material engaging member having protruding portions oriented to extend in a direction away from the surface of the units for engagement with the netting material as the netting material is wrapped around the units. A forming and feeder mechanism, receiving a continuous supply of the reasonably stiff material, forms the material engaging member into the desired configuration and shape, and then dispenses the thus formed member into the wrapping station where the formed member is severed from the continuous supply by the forming and feeder mechanism after the formed material at the wrapping station has been contacted by a plurality of wrapped layers of the netting material. A variably positionable net manipulation arm is utilized for holding the netting material in place against the units during the initial wrapping cycle of netting material about the palletized articles, with the arm being moved away from the wrapping station and clear of the wrapping process during subsequent wrapping cycles, except that, after the final wrapping cycle, the arm is again brought into engagement with the netting material to hold the netting material in a spaced relationship with respect to the units to enable a severing arm to sever inwardly of the arm that portion of the netting material not wrapped about the articles, so that the manipulation arm engages, and continues to engage, the netting material at the supply side of the netting material, the manipulation arm then being ready for use in wrapping units on the next pallet presented at the wrapping station.

18 Claims, 10 Drawing Sheets

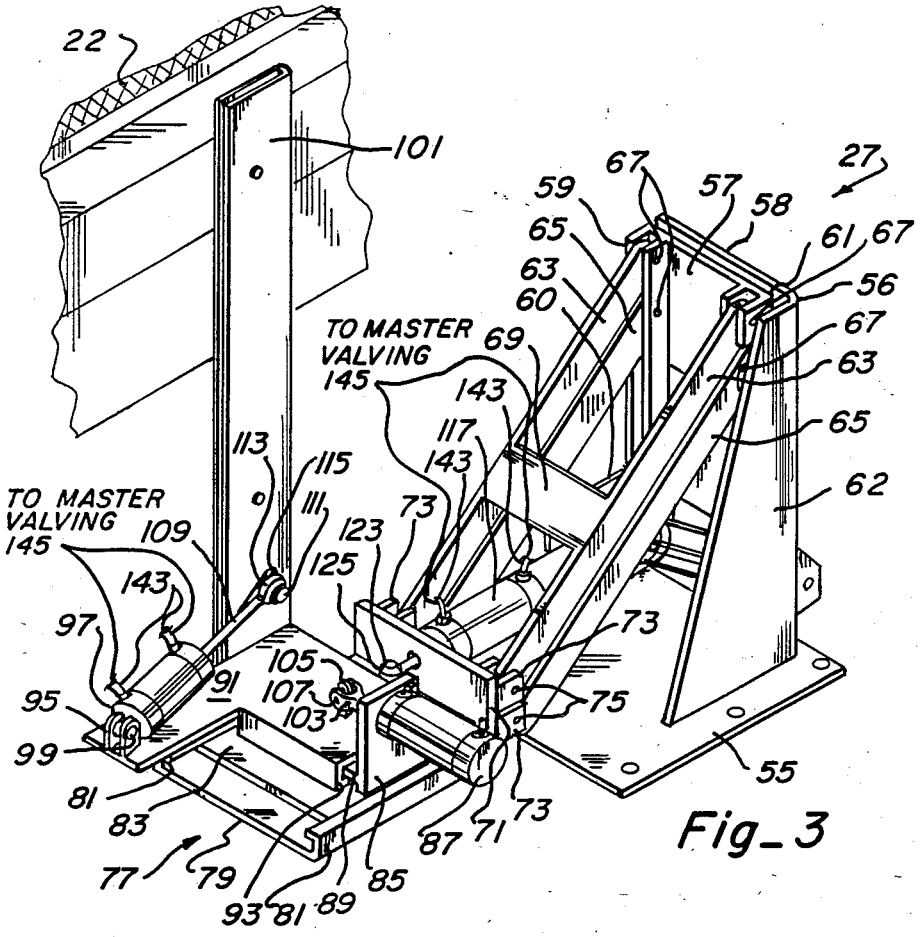
Fig_3
Fig_4
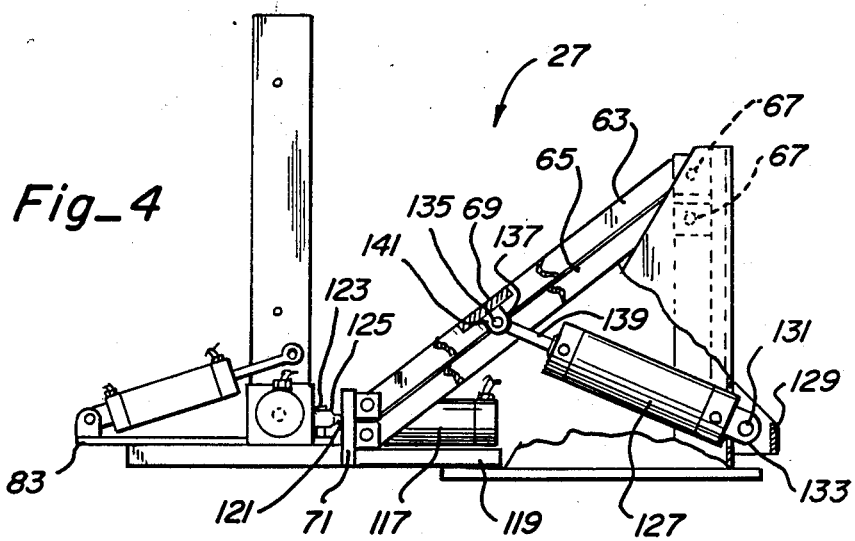

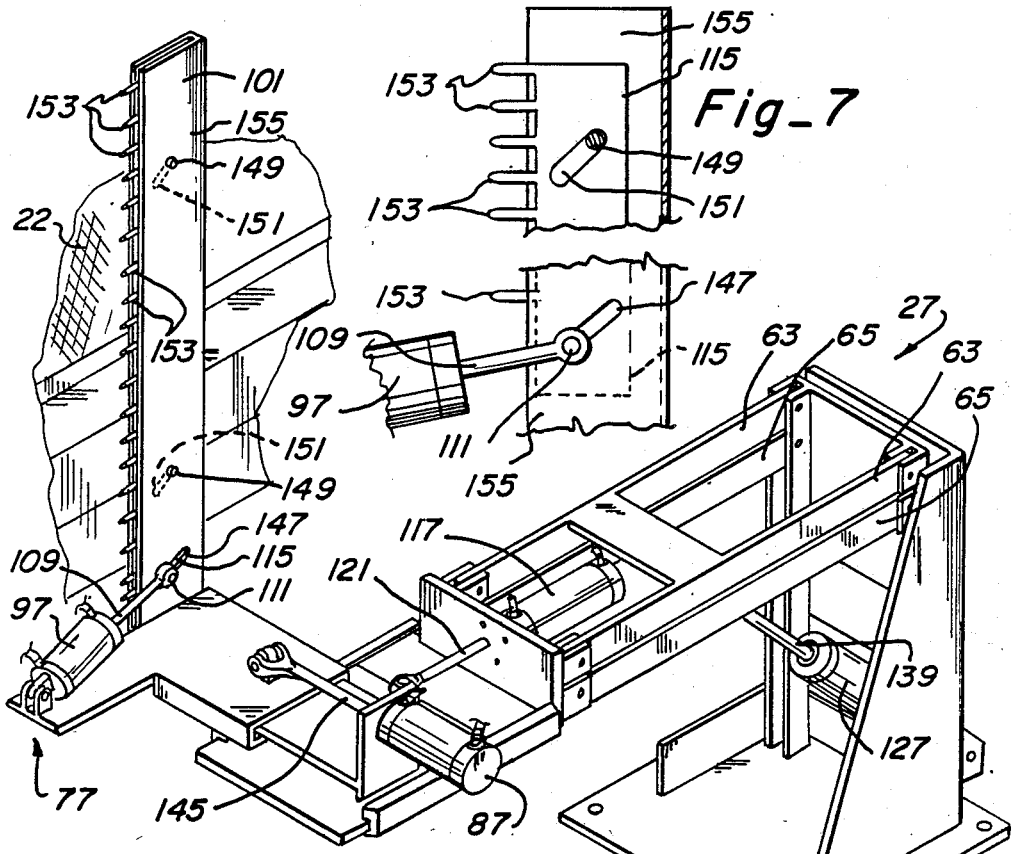
Fig_7
Fig_5
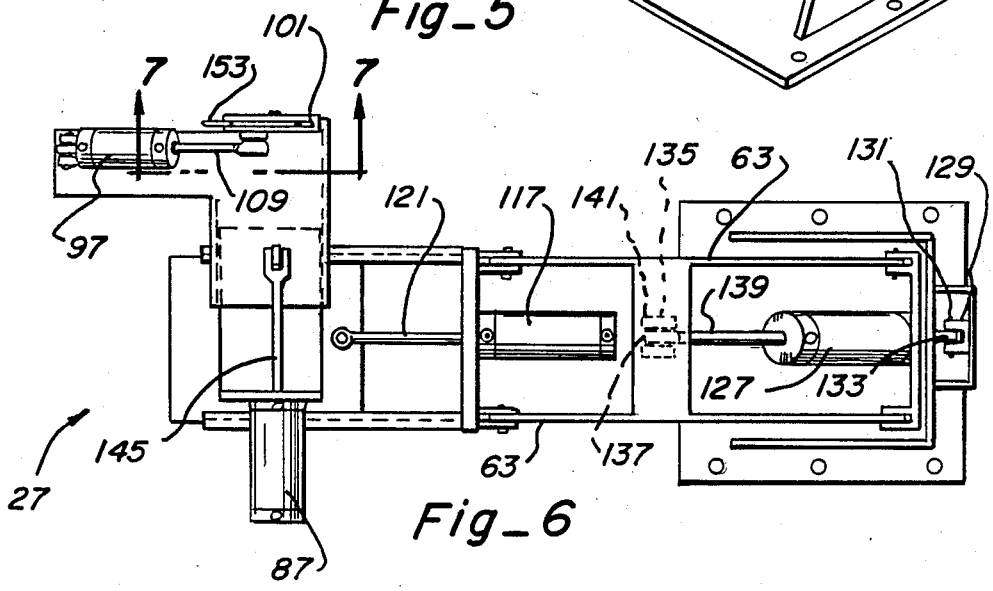
Fig_6

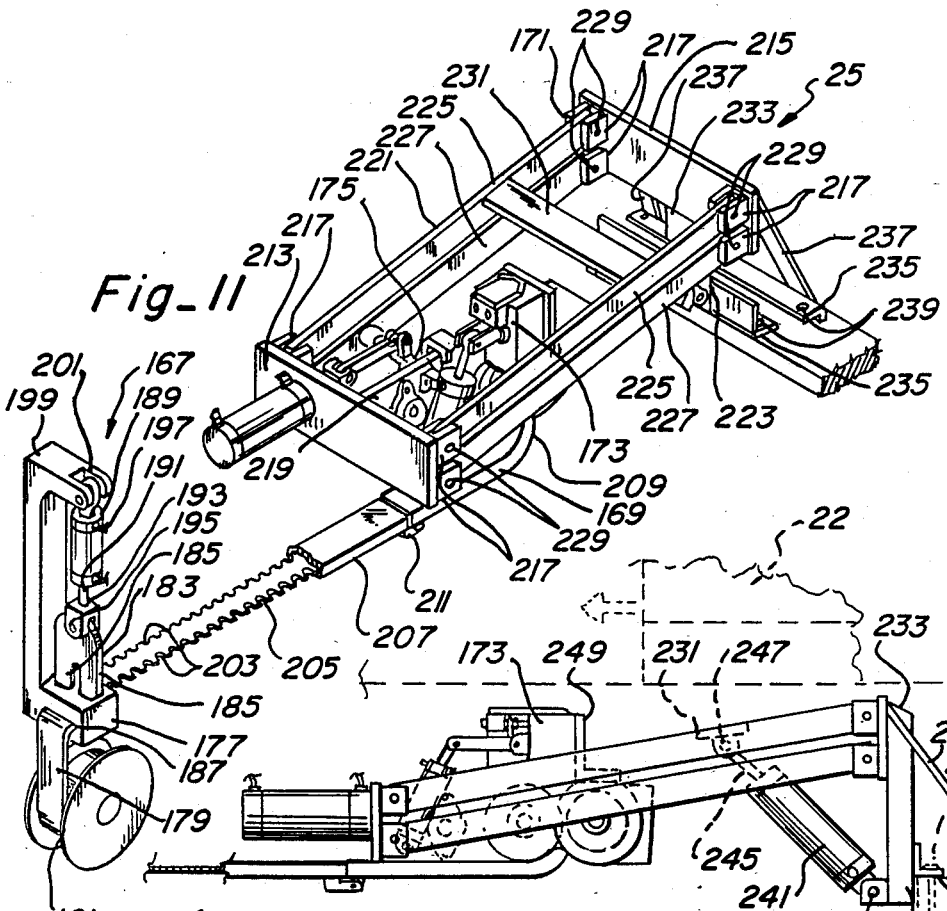
Fig_11
Fig_12
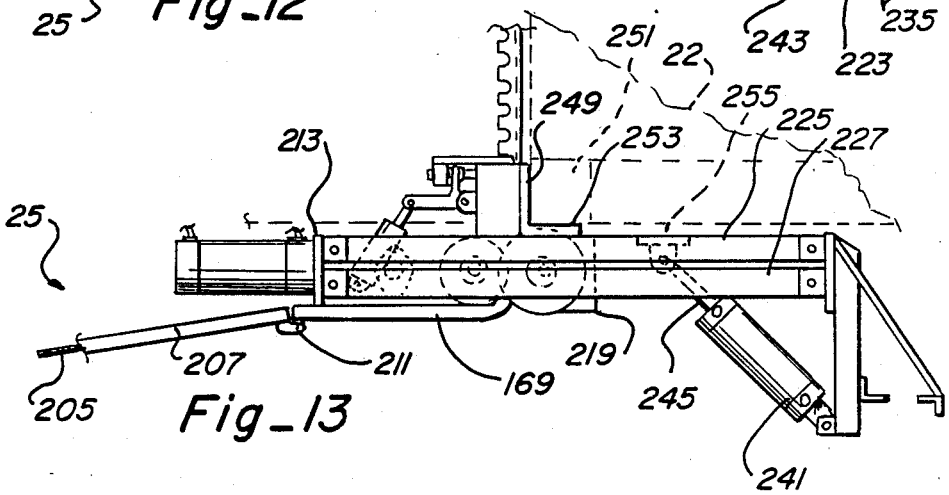
Fig_13

MATERIAL ENGAGING AND SECURING DEVICE

RELATED APPLICATION

This application is a division of U.S. patent application Ser. No. 943,741, filed Dec. 19, 1986, and entitled "MATERIAL POSITIONING AND SECURING APPARATUS AND PROCESS" now U.S. Pat. No. 4,747,252.

FIELD OF THE INVENTION

This invention relates to devices for engaging and securing wrapping material about articles and, more particularly, relates to a device for securing a net of stretchable material around articles, such as palletized articles, to form a retainable assemblage.

BACKGROUND OF THE INVENTION

The use of apparatus and/or processes for wrapping material around a plurality of articles to form a retainable assemblage is now known (see, for example, U.S. Pat. Nos. 4,216,640 issued Aug. 12, 1980 to Kaufman, 4,302,920 issued Dec. 1, 1981 to Lancaster et al, 4,235,062 issued Nov. 25, 1980 to Lancaster et al, 4,204,377 issued May 27, 1980 to Lancaster et al, 4,300,326 issued Nov. 18, 1981 to Stackhouse, 4,255,918 issued Mar. 17, 1981 to Lancaster et al, 4,110,957 issued Sept. 5, 1978 to Lancaster et al, 4,077,179 issued Mar. 7, 1978 to Lancaster et al, and 4,232,501 issued Nov. 11, 1980 to Stackhouse), and such apparatus and/or processes have heretofore been used in association with devices for spirally wrapping palletized articles with a web of stretchable material and the like.

Now known apparatus and/or processes for securing a net of stretchable material around articles have usually required the use of roper mechanisms to form the leading and trailing edges of the material into a rope-like configuration and/or have required provision of anvil members and clamping members for the holding and securing together of the rope-like leading and trailing edges of the material by, for example, tying, stapling or the use of ring clamps (see, for example, U.S. Pat. Nos. 4,271,657, issued June 9, 1981 to Lancaster, III et al, and 4,432,185, issued Feb. 21, 1984 to Geisinger). Improvements in such securing apparatus and/or processes are, therefore, deemed to be still useful and/or needed.

SUMMARY OF THE INVENTION

This invention provides an improved device for engaging and reliably securing material around a plurality of units, for example, palletized cans, cartons and the like, to form a retainable assemblage. The device is thus particularly useful in association with devices for wrapping units with stretchable material, such as netting material, and includes a first portion positionable adjacent to the units, and second portion having a plurality of engaging members, or fingers, extending therefrom at least some of which extend away from the units for engaging the netting material at least during a final wrap about the units to thereby maintain the netting material around the assemblage without requiring the use of roping mechanisms and/or stapling of the material. The device is preferably made of inexpensive, and thus disposable, material which is relatively stiff and yet deformable.

It is therefore an object of this invention to provide an improved device for engaging and securing material around a plurality of units to form a retainable assemblage.

It is another object of this invention to provide an improved device for engaging and securing a net of stretchable material around a plurality of units to form a retainable assemblage.

It is still another object of this invention to provide an improved device for securing material around units that can be used in association with devices for spirally wrapping such units with such wrapping material.

It is still another object of this invention to provide an improved device for engaging and securing a net of stretchable material around a plurality of units which includes a first portion positionable adjacent to the units, and a second portion connected with the first portion having a plurality of engaging members at least some of which extend away from the units.

It is still another object of this invention to provide a disposable fastener for securing a net of stretchable material around a plurality of units which includes an elongated central portion having fingers extending therefrom.

It is yet another object of this invention to provide an improved fastener for securing material wrapped around a plurality of units which is made from a relatively stiff yet deformable material, and is configured so that, when positioned adjacent to a surface of the plurality of units in advance of wrapping, at least one of the final wraps of the material around the units is engaged by the fastener for securing the material around the units.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 3 is a perspective view of a net manipulating mechanism, shown in a retracted position, which is used in association with the material positioning and securing apparatus shown in FIG. 2;

FIG. 4 is a side elevation view of the net manipulating mechanism shown in FIG. 3;

FIG. 5 is a perspective view of the net manipulating mechanism shown in FIGS. 3 and 4 but illustrating the mechanism positioned against palletized units with the material engaging fingers extended;

FIG. 6 is a top elevation view of the net manipulating mechanism as shown in FIG. 5;

FIG. 7 is a partial side sectional view of the net manipulating arm taken through lines 7—7 of FIG. 6, with portions thereof broken away to illustrate the retractable material engaging structure;

FIG. 11 is a perspective view of a forming and positioning mechanism for forming the material engaging and securing device from a substantially continuous supply of unformed stock material;

FIG. 12 is a side elevation view of a portion of the forming and positioning mechanism shown in FIG. 11;

FIG. 13 is a side elevation view of the forming and positioning mechanism shown in FIGS. 11 and 12 illustrating the position thereof when positioning the formed material engaging and securing device adjacent to the palletized units;

DESCRIPTION OF THE INVENTION

Figure 1:
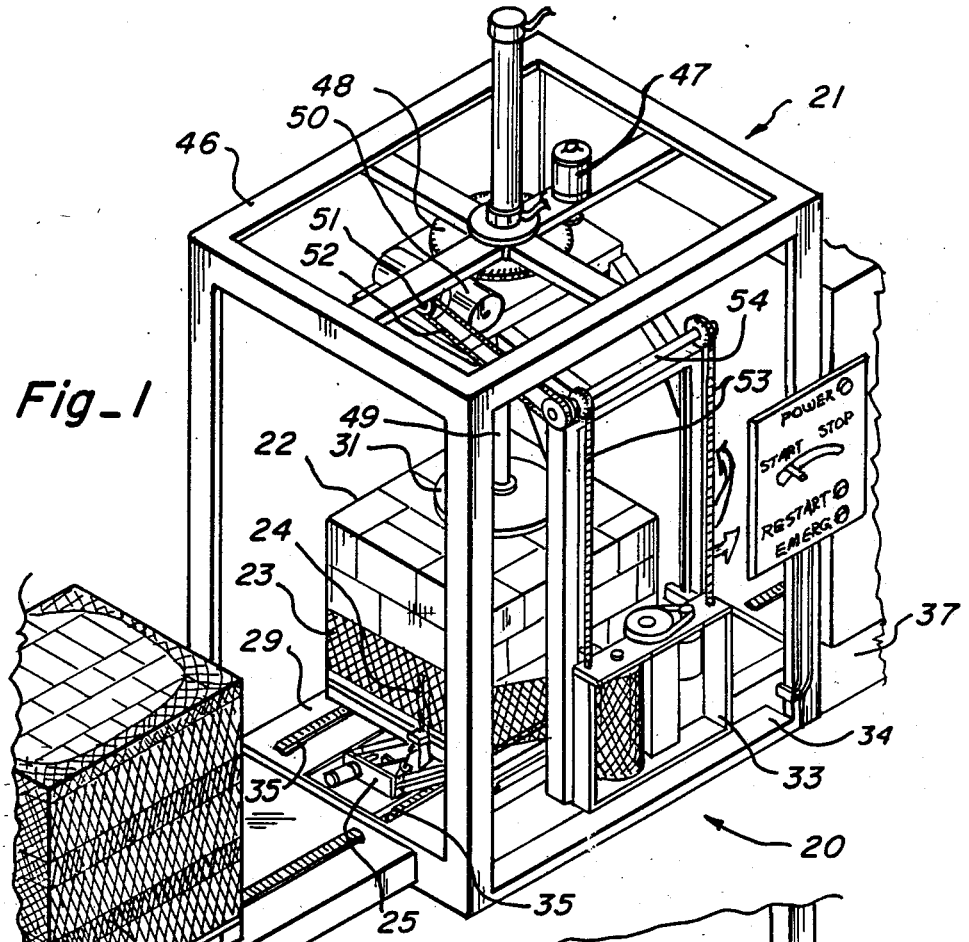
FIG. 1 is a perspective view of a material positioning and securing apparatus shown in connection with a palletizer mechanism and pallet transfer mechanism with the positioning and securing apparatus positioned during the initial stage of wrapping of material about units on a pallet positioned at a wrapping station and illustrating the material engaging and securing device of this invention positioned adjacent to the units.
Figure 2:
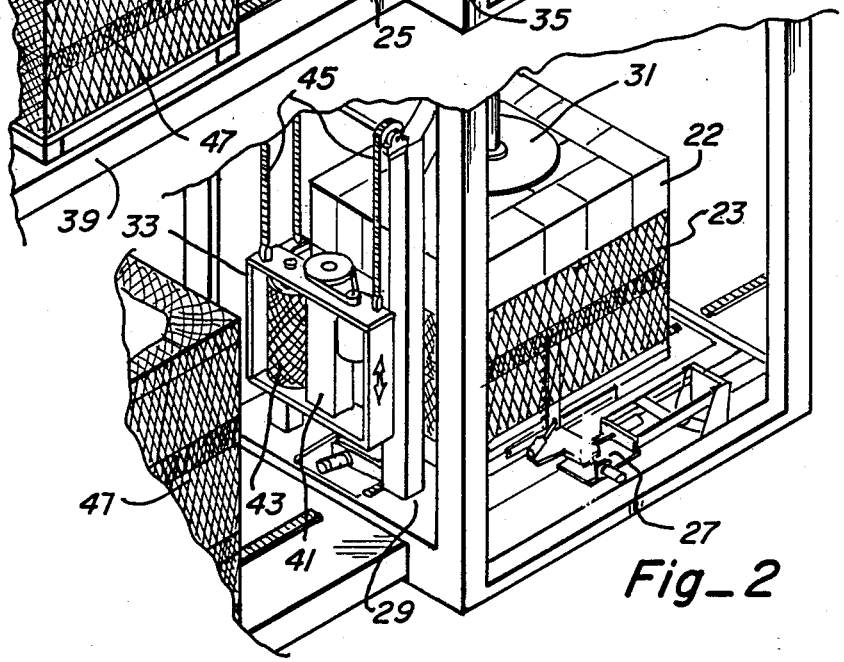
FIG. 2 is a perspective view of the material positioning and securing apparatus as shown in FIG. 1, but showing the wrapping assembly of the palletizer mechanism during the middle stage of wrapping a net of stretchable material around palletized units.

Material positioning and securing apparatus 20 is shown in FIGS. 1 and 2 in association with palletizer mechanism 21, which mechanism is utilized, as illustrated, to wrap palletized units 22 with material 23, herein shown as a stretchable netting material, with FIG. 1 showing an initial wrapping stage and FIG. 2 showing an intermediate wrapping stage. Netting material 23 may, for example, be a pliable plastic, one-inch mesh netting having a stock width of 24" using a 0.016" diameter cord. Material positioning and securing apparatus 20, as best shown in FIG. 1, utilizes a disposable material engaging member 24 in accord with this invention, and includes forming and positioning mechanism 25 and, as more completely shown in FIG. 2, net manipulator mechanism 27.

Palletizer mechanism 21 is positioned at pallet receiving and unit wrapping area, or station, 29 to wrap material 23 about palletized units thereat. As shown, palletizer mechanism 21 includes control unit 30 for control of apparatus 20 and mechanism 21, stabilizing assembly 31 and wrapping assembly 33. While wrapping assembly 33 is shown herein to be movable around palletized units 22 to wrap material thereabout, it is to be realized that rotation of the palletized units with respect to a stationary wrapping assembly could also be employed (both arrangements being now known in the art), and still make use of the herein disclosed invention.

Palletizer mechanism 21, as shown in FIG. 1, further includes unit position sensor 34 for sensing the proper positioning of palletized units to be wrapped, and pallet transporting tracks 35 for transport of palletized units 22 between incoming and outgoing delivery line sections 37 and 39, respectively. As shown in FIGS. 1 and 2, wrapping assembly 33 includes net dispenser mechanism 41, having a continuous supply 43 of netting material 23, and wrap positioning apparatus 45 for vertically moving dispenser mechanism 41 a wrapping assembly 33 rotates around palletized units 22 thereby distributing net material 23 along the vertical surfaces of palletized units 22 (i.e., a spiral winding of net material is effected about the palletized articles).

Stabilizing assembly 31 is extendable downwardly from framework 46. Motor 47 rotates gear wheel and platform assembly 48 around shaft 49 thereby driving wrapping assembly 33 connected with the platform assembly around wrapping station 29 and, therefore, units 22 positioned thereat. Motor 50 on gear wheel and platform assembly 48 rotates with the platform and also rotates sprocket 51 thereby driving drive chain 52 and, thereby, endless chains 53 on connecting shaft 54 for vertical movement of net dispenser 41. Rotation of assembly 33 together with vertical movement of dispenser 41 are thus employed to facilitate spiral winding of netting material 23 about units 22, as is well known in the art, upon sensing of a properly positioned unit by sensor 34.

FIGS. 3 through 6 show, in greater detail, net manipulator mechanism 27 of web positioning and securing apparatus 20. In FIG. 3, net manipulator mechanism 27 is shown with respect to palletized units 22 for reference purposes, and includes horizontal base 55 having vertically extending mounting plate 56 attached thereto. Positioning arm receiving stand 57 is attached to mounting plate 56 (at rear portion 58 thereof) with inside channel leg 59 being positioned adjacent plate 60 and outside channel leg 61 being adjacent support wing 62 of mounting plate 56, one mounting leg being positioned at each side of receiving stand 57.

Upper and lower positioning arms 63 and 65 are receivable at the upper portion of channel legs 59 and 61, retained therein by hinge pins 67, spacer plate 69 being attached between upper positioning arms 63. Net engaging assembly mounting plate 71, having positioning arm receiving channels 73 attached thereto, is mounted on the opposite ends of upper and lower positioning arms 63 and 65, hinge pins 75 maintaining arms 63 and 65 in channels 73. When thus positioned plate 71 is maintained in a substantially vertical position during movement of arms 63 and 65.

Net engaging assembly 77 is attached to mounting plate 71 and includes supporting base 79 having slide channels 81 along opposite sides thereof. Slidable mounting plate 83 is receivable in channels 81 and has cylinder support 85 attached thereto for support of cylinder 87. Cylinder support 85 has manipulating arm base extending plate 89 attached thereto for slidable receipt of net manipulating arm base 91 at channels 93 (only one of which is shown in FIG. 3).

Base 91 includes cylinder mounting hinge 95 for mounting of net manipulating arm control cylinder 97 by hinge pin 99. Net manipulating arm 101 is attached to base 91. Cylinder 87 slidably controls manipulation arm base 91 by connection of cylinder shaft yoke 103 to connecting eye 105, attached to base 91, using connecting pin 107. Control cylinder 97 includes shaft 109 connected, by connecting pin 111 through shaft yoke 113, to net engaging plate 115 (better shown in FIG. 7) of net manipulating arm 101.

As shown in FIG. 4, slidable mounting plate 83 is movable by cylinder 117 mounted to net engaging assembly mounting plate 71 and support plate 119. Shaft 121 passes through mounting plate 71 and is connected to plate 83 by connecting pin 123 through shaft yoke 125 (as also shown in FIG. 3). Positioning arms 63 and 65 are movable on hinge pins 67 by control cylinder 127 mounted between mounting block 129 and spacer plate 69. Hinge pin 131 retains cylinder 127 at block 129 through channel 133. Hinge pin 135 maintains mounting eye 137 of shaft 139 within mounting block 141 attached to spacer plate 69 (as also shown in FIG. 6).

Figure 20:
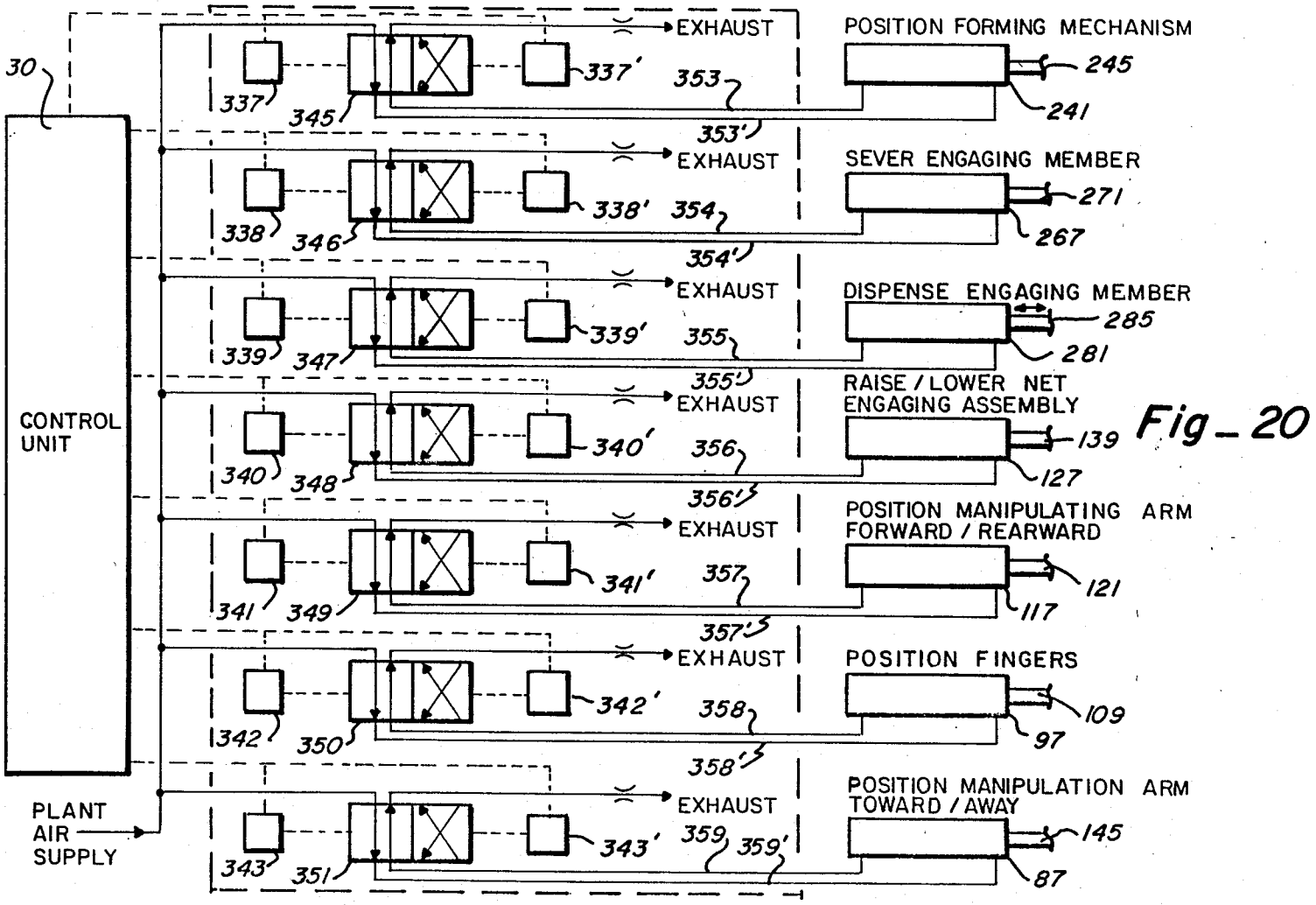
FIG. 20 is a pneumatic flow control schematic illustrating one valving scheme suitable for application of positive air pressure to the air cylinders of the material positioning and securing apparatus.

All cylinders shown herein are pneumatic cylinders having fully extended and fully retracted shaft positions (for example, cylinders 87, 117 and 127 in FIGS. 3 and 4 are in fully retracted positions while cylinder 97 is fully extended), the positions being changeable by application of appropriate air pressure within the cylinder from an appropriate supply through positive pressure supply lines (for example, lines 143 to cylinders 97 and 117 in FIG. 3) and valving (as shown for cylinders 97 and 117, lines 143 extend to master valving 145, a schematic diagram of which is shown in FIG. 20). Of course other position control mechanisms could be used, for example, hydraulic cylinders or the like, and remain within the scope of the instant invention.

Turning now to FIGS. 5 and 6, net manipulator mechanism 27 is shown (with respect to palletized units 22 in FIG. 6) with cylinders 87, 117 and 127 in fully extended positions and cylinder 97 in a fully retracted position as would be the case during the initial stage of wrapping. Extension of shaft 139 from cylinder 127 causes positioning arms 63 and 65 to assume a substantially horizontal position thereby raising net engaging assembly 77 to a position such that net manipulating arm 101 may be positioned adjacent palletized units 22. Extension of shaft 121 from cylinder 117 moves arm 101 forward, and shaft 145, when extended from cylinder 87, moves arm 101 inward toward palletized units 22 to a position where arm 101 is adjacent palletized units 22.

As shown in FIG. 7, retraction of shaft 109 into cylinder 97 causes pin 111 to slide in diagonal slot 147 and move net engaging plate 115 forward on guide pin 149 through diagonal slot 151 in plate 115 thereby freeing net engaging fingers 153 from protective outer sheath 155. When fingers 153 are thus exposed, as would be the case during the positioning initially of net material 23 or prior to reengagement of material 23 for severing thereof from supply 43, netting ma be engaged and held by net manipulation arm 101 extension of shaft 109 from cylinder 97 causing retraction of fingers 153 and, thereby, release of netting as would be the case during the middle stages of the wrapping process.

Figure 8:
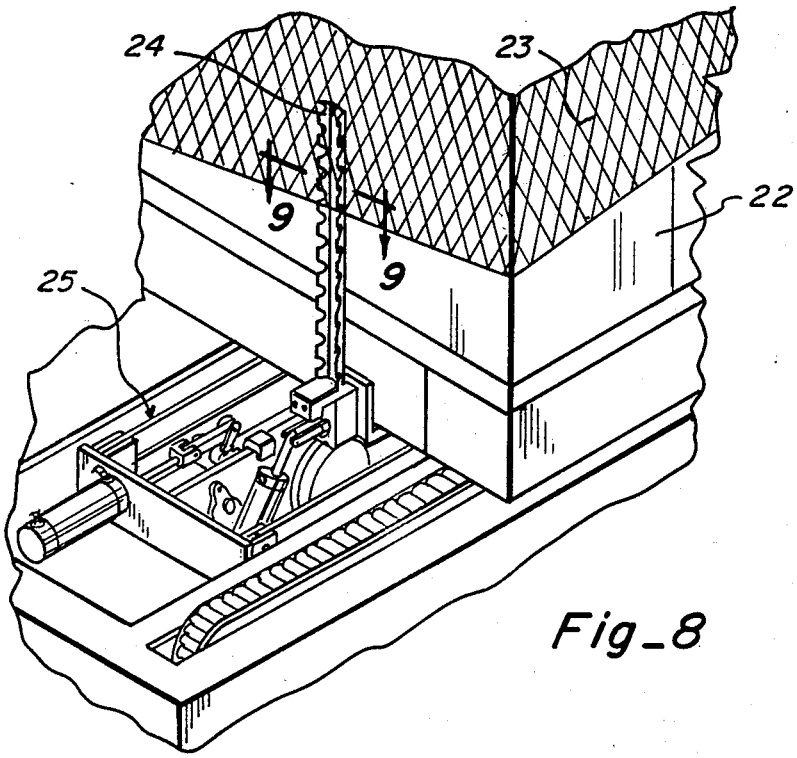
FIG. 8 is a partial perspective view illustrating application of the material engaging and securing device of this invention for engagement of a net of stretchable material being wrapped around palletized units.

Turning now to the disposable positioner element, or net engaging member, 24 of this invention, this element is shown in FIG. 8 to be formed as an elongate strip dispensed from forming and positioning mechanism 25 for engagement with net 23. Net engaging member 24 is formed from a continuous supply of stock, being formed as more fully set forth hereinafter. Net engaging member 24 is formed from a relatively stiff, yet deformable material and may be, for example, an elongate plastic strip material two inches in width and one sixty-fourth of an inch thick.

Figure 9:
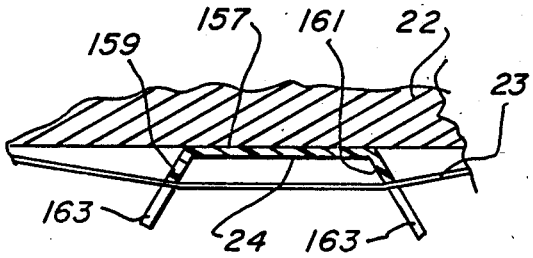
FIG. 9 is a partial top sectional view taken through lines 9—9 of FIG. 8.
Figure 10:
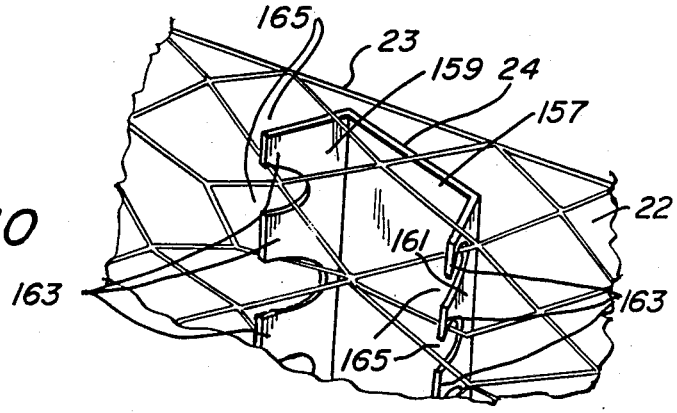
FIG. 10 is a partial perspective view of the material engaging and securing device as shown in FIG. 8 and particularly illustrating netting material being engaged thereby.

As shown in FIGS. 9 and 10, engaging member 24 is positioned adjacent units 22 with a body portion 157 residing against units 22 and ear portions 159 and 161 extending angularly away from units 22 in opposed directions. The strip may be of various lengths corresponding to the netting stock width. The body portion may, for example, be one inch wide, with the ears each being one-half inch wide. Ear portions 159 and 161 include a plurality of net engaging projections 163 formed by curved detents cut in the member, each projection being, for example, one eighth of an inch wide and three eighths of an inch long.

As stretchable net 23 is wrapped around palletized units 22 and over net engaging member 24, engaging member 24 is held in place while the individual cells 165 of net 23 engage projections 163 and net 23 is thereby held in place as overlapping layers of net 23 are stretched over engaging member 24. It should be appreciated that only the final two wraps of net 23 must be engaged by engaging member 24, though a more secure package is achieved if both initial and find wraps are thus engaged. It should be further appreciated that engaging member 24 need not be rigid and that only the engaging projections 163 must have sufficient rigidity for the netting to be held in place.

FIGS. 11 through 15 show net engaging member forming and positioning mechanism 25 of web positioning and securing apparatus 20. In FIG. 11, mechanism 25 is shown to include die assembly 167, input channel 169, mechanism framework 171, net engaging member cutoff assembly 173 and molding wheels drive assembly 175. Die assembly 167 includes guide block 177 for receipt therethrough of unformed material 179 from, for example, roll 181. Die 183 has individual cutting blades 185 which are slidably maintained in block 177 for communication with channel 187 to allow cutting of unformed material 179.

Die 183 is movable by cylinder 189 having shaft 191 and yoke 193 mounted to die 183 with pin 195. Cylinder 189 may, by way of example, be a pneumatic cylinder with extended and retracted shaft positions caused by a suitable air supply through supply lines 197. Cylinder framework 199 maintains cylinder 189 at yoke 201 using, for example, a pin and eye arrangement. As thus configured, die assembly 167 causes detents 203 to be cut in both sides of unformed material 179 thereby preparing partially formed material 205 for receipt at input channel 169.

Input channel 169 includes receiving section 207 and material directing section 209 attached to framework 171, sections 207 and 209 being joined at hinge 211. Mechanism framework 171 comprises front and rear walls 213 and 215 having yokes 217 attached thereto, cutoff and molding assemblies mounting plate 219 extending from front wall 213, positioning arm assembly 221 between front and rear walls 213 and 215, and base assembly 223. Upper and lower positioning arm 225 and 227 of arm assembly 221 are joined to yokes 217 by pins 229 and support plate 231 is attached between upper arms 225.

FIGS. 11 and 12 show base assembly 223 to include support post 233, mechanism mounting members 235 and braces 237. Base assembly 223 is thereby appropriately positionable within receiving area 29 of palletizer mechanism 21 (as shown in FIG. 1) using, for example, bolts 239.

As shown in FIG. 12, forming and positioning mechanism 25 resides below the path of outflow of palletized units 22 after completion of positioning and securing of the material. Cylinder 241, attached at hinge 243 to support 233, has shaft 245 attached at hinge 247 to support plate 231. Cylinder 241 (for example, a pneumatic cylinder), when maintaining shaft 245 in its fully retracted position, causes pallet positioning element 249 attached to cutoff assembly 173 to remain below the outflow path.

As shown in FIG. 13, when shaft 245 is fully extended by cylinder 241, upper and lower positioning arms 225 and 227 raise front wall 213 and assembly mounting plate 219 so that pallet positioning element 249 is positioned for receipt of pallet 251, horizontal wall 253 of positioning element 249 being adjacent to, and substantially vertically coextensive with, base plate 255 of receiving area 29 of palletizer mechanism 21. Hinge 211 of input channel 169 allows receiving section 207 to assume a downward slope so as not to disrupt the flow of partially formed material 205 through the channel.

Figure 14:
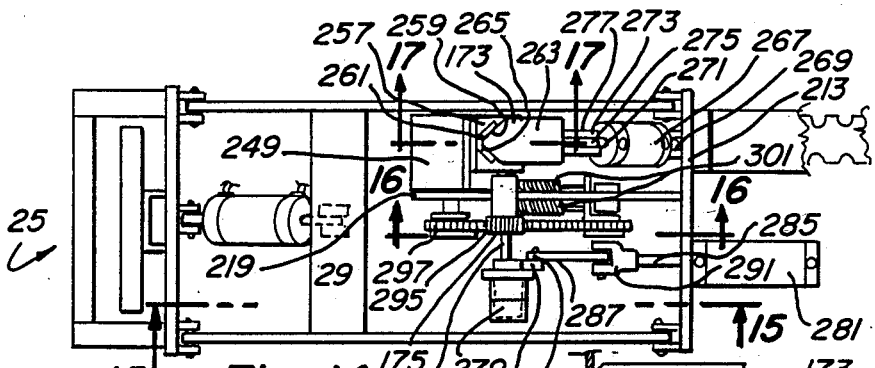
FIG. 14 is a top elevation view of the forming and positioning mechanism shown in FIGS. 11 through 13.

Turning now to FIGS. 14 through 18, cutoff assembly 173 and molding wheels drive assembly 175 are shown. Cutoff assembly 173 includes cutting surface 257 adjacent positioning element 249 and is connected to assemblies mounting plate 219 as shown in FIG. 14. Formed material channel 259 passes through cutting surface 257, formed material being directed therethrough by guide 261. Cutting blade 263, having cutting edge 265, resides over surface 257, cutting edge 265 being adjacent channel 259. Cylinder 267 is attached at front wall 213 at hinge 269 and has shaft 271 extending therefrom and attached to lever arm 273 at eye 275 by hinge pin 277.

While ratchet 279, powered by cylinder 281, is shown in drive assembly 175, it is by way of example only, it being understood that alternative means of empowering the drive assembly could be employed consistently with the invention herein described. Ratchet 279 includes ratcheting arm 283 connected with cylinder shaft 285 by connecting arm 287 at hinged junctions 289 and 291. Ratchet 279 turns drive shaft 293 and, therefore, toothed gear 295 thereby moving drive chain 297 in only one direction. Shaft 293 extends through plate 219 for connection to drive wheel 299 (shown in FIG. 18). Assemblies stabilizing structure 301 is attached to plate 219.

Figure 15:
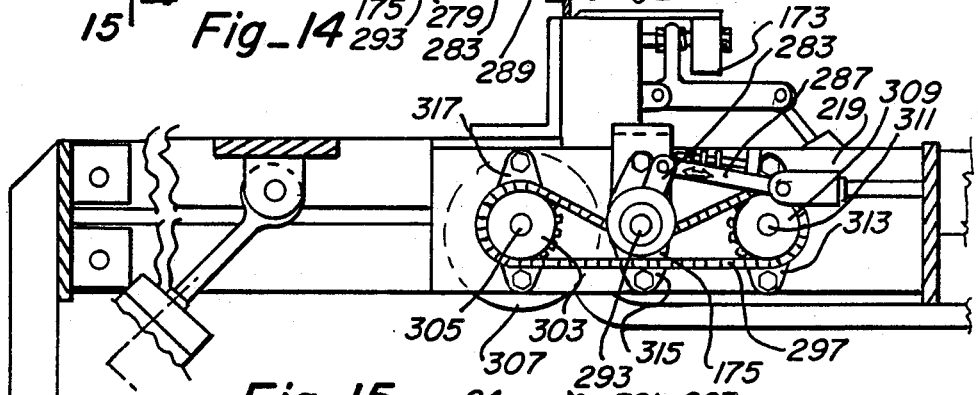
FIG. 15 is a side sectional view taken through lines 15—15 of FIG. 14.

In FIG. 15 further detail of molding wheels drive assembly 175 is shown. Molding wheel drive gear 303 is mounted on shaft 305 which extends through plate 219 where molding wheel 307 (shown also in FIG. 18) is attached. Idler gear 309 is mounted on shaft 311 extending into bearing 313 in plate 219. Bearings 315 and 317 are also mounted in plate 219 to accommodate shafts 293 and 305. Drive chain 297, upon one-way movement by toothed gear 295 (shown in FIG. 14) caused by reciprocal movement of connecting arm 287 and ratcheting arm 283, causes molding wheel 307 and drive wheel 299 to rotate in opposite directions thereby shaping partially formed material 205 into engaging member 24 and feeding member 24 through channel 259 (as more clearly shown in FIGS. 17 and 18).

Figure 16:
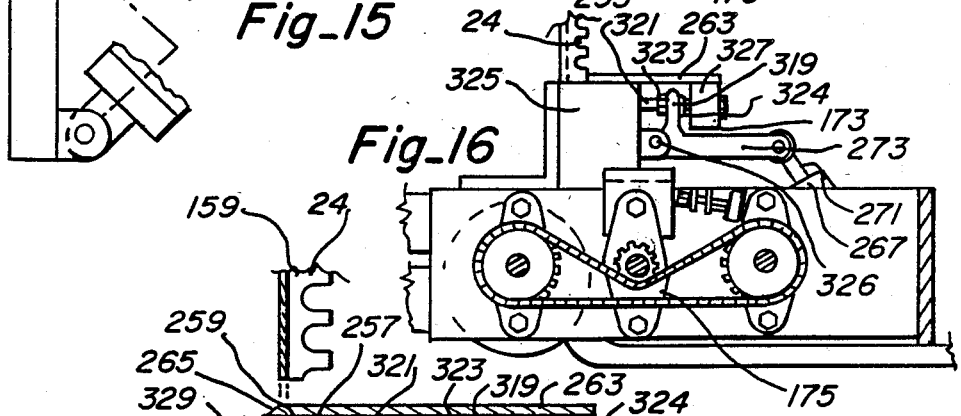
FIG. 16 is a partial side sectional view taken through lines 16—16 of FIG. 14.
Figure 17:
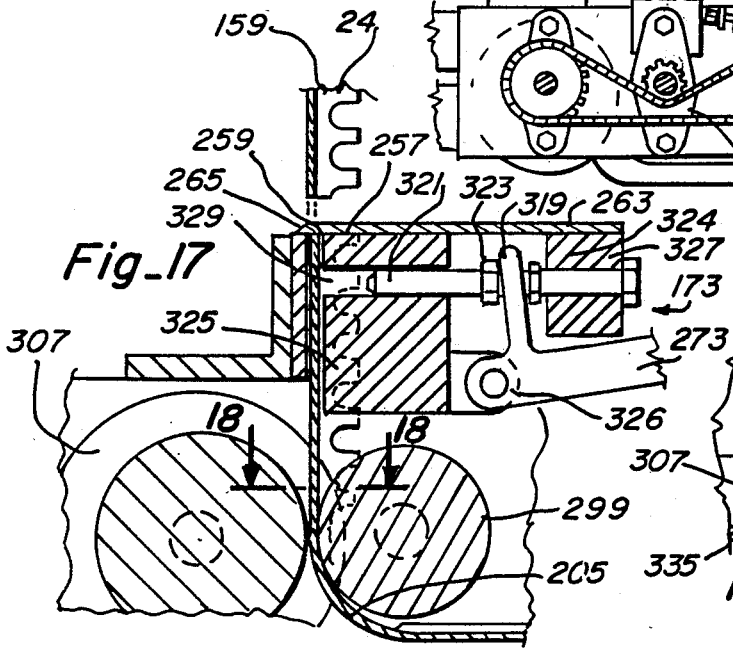
FIG. 17 is a partial side sectional view taken through lines 17—17 of FIG. 14.

FIGS. 16 and 17 show cutoff assembly 173. Lever arm 273 is substantially horizontal when shaft 271 is fully retracted as in FIG. 16. Lever arm 273 is slidably connected, through eye 319, to shaft 321 between front and rear retainer nuts 323 and 324 and to material channel housing 325 at hinge 326. Shaft 321 is immovably attached at one end to blade transport block 327 having cutting blade 263 attached thereto. Shaft 321, at its opposite end, is housed in shaft housing 329 (shown in FIG. 17). Upon extension of shaft 271 by cylinder 267, lever arm 273 is elevated at one end thereby moving eye 319 forward where contact with nut 323 causes shaft 321, and therefore cutting blade 263, to move forward and cutting edge 265 to sever engaging member 24 at cutting surface 257, as shown in FIG. 17.

Figure 18:
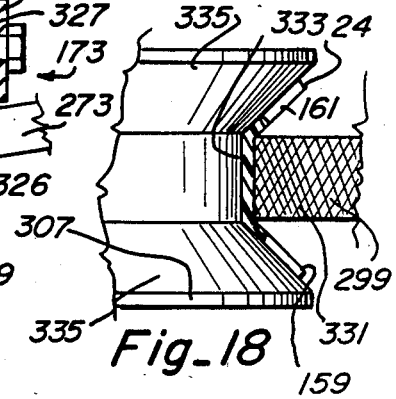
FIG. 18 is a partial top sectional view taken through lines 18—18 of FIG. 17.

FIG. 18 shows in detail the configuration of drive wheel 299 and molding wheel 307. Drive wheel 299 has abrasive surface 331 for feeding member 24 through the apparatus while also bringing the material into contact with mating face 333 of molding wheel 307. In this fashion, partially formed material 205 is creased by angular wheel walls 335 thereby forming ear portions 159 and 161 of engaging member 24 (as also shown in FIG. 17).

Figure 21:
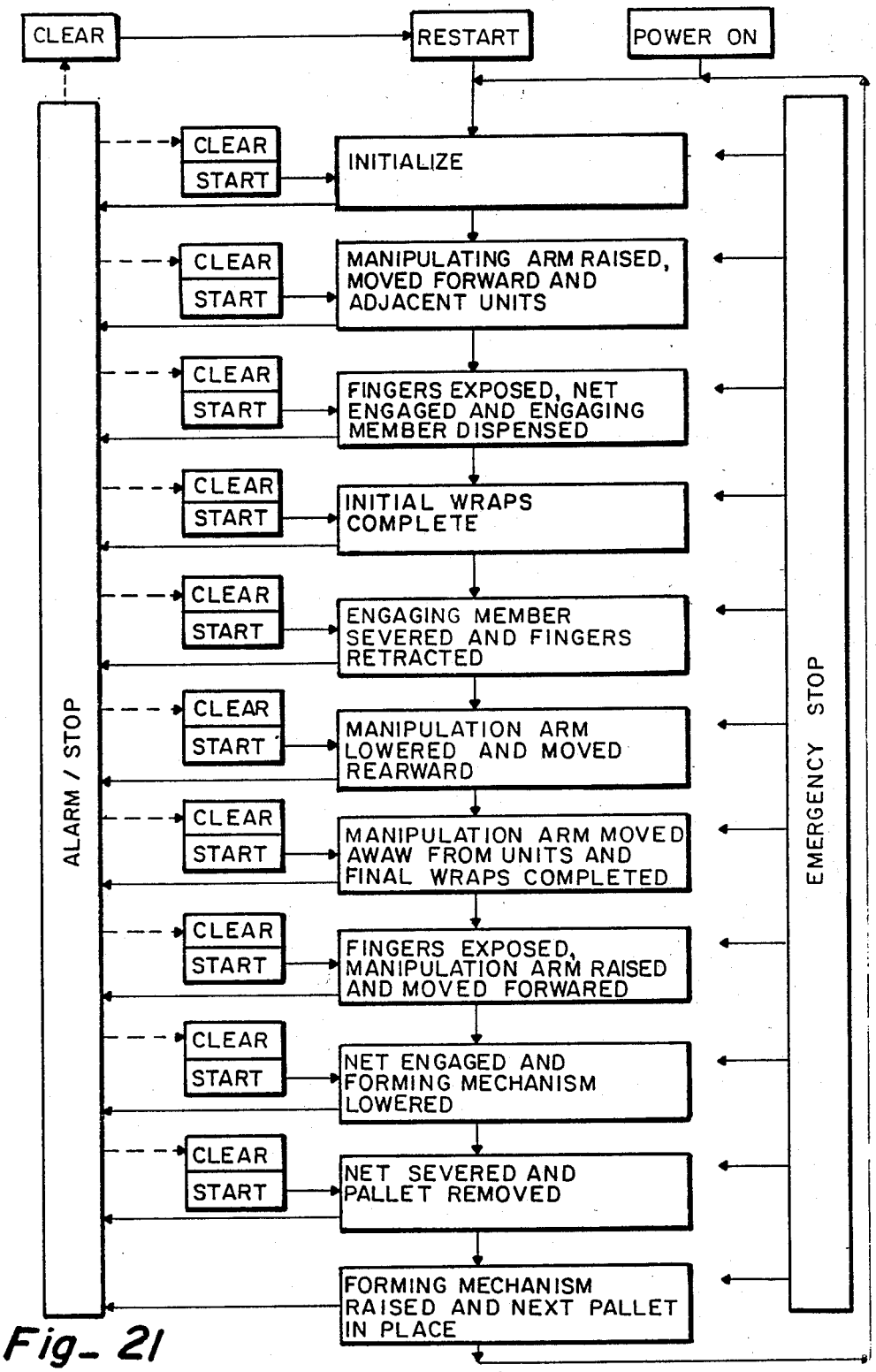
FIG. 21 is a flow diagram illustrative of control unit programming suitable for operation of the material positioning and securing apparatus.

FIGS. 19*a* through 19*d* show the process of wrapping palletized units 22 employing web securing and positioning apparatus 20 and palletizer mechanism 21. Use of appropriate control arrangements, for example the use of position sensing device 34 as shown in FIG. 1 in cooperation with a valving arrangement for control of pneumatic cylinders, as illustrated in the pneumatic schematic of FIG. 20, and programmable logic controller 30 (for example the Allen Bradley, Model PLC 205 or 215), is well known for the serial orchestration of events, and many such arrangements may be applicable in control of the wrapping process hereinafter described (FIG. 21 is a flow diagram illustrative of a control program suitable of controlling the steps set out hereinbelow).

Figure 19A:
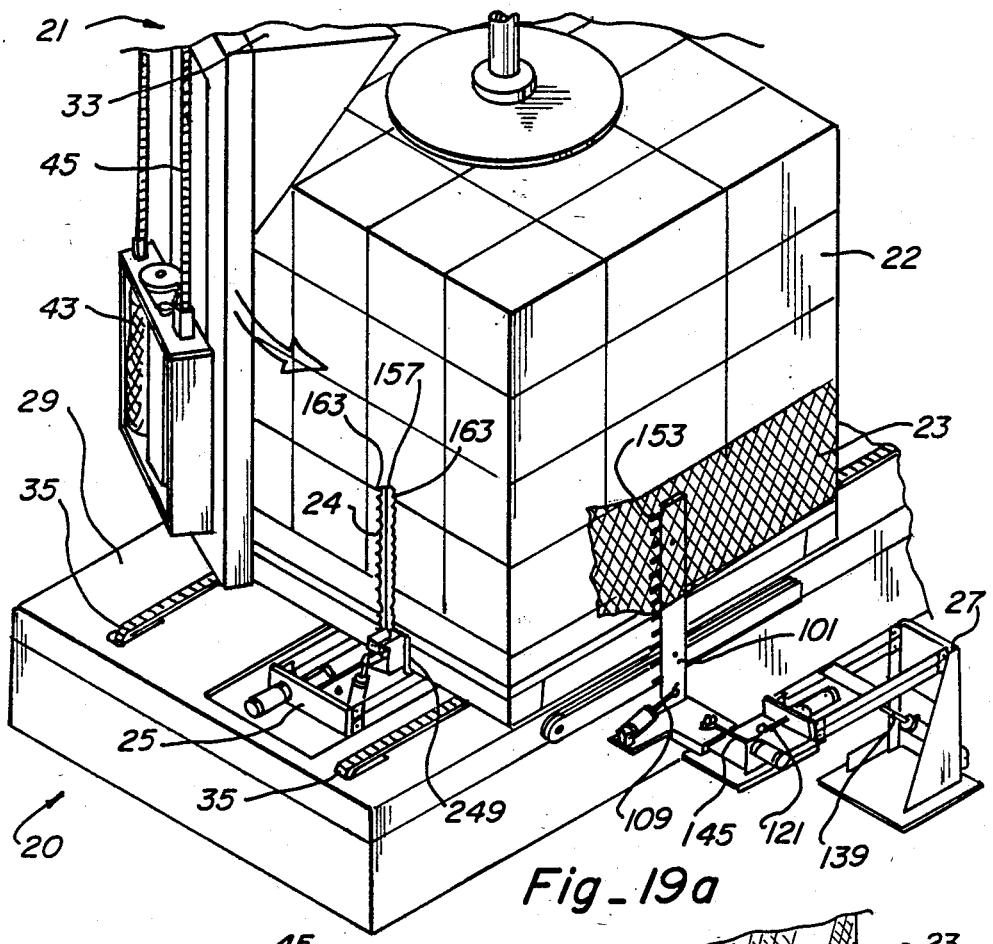
FIGS. 19*a* through 19*d* are views of the material positioning and securing apparatus shown in FIG. 1 and illustrating operation of the apparatus during positioning and securing of a net of stretchable material around palletized units utilizing the material engaging and securing device of this invention.

As shown in FIG. 19*a*, palletized units 22 are moved by tracks 35 to receiving area 29 and against positioning element 249 of forming and positioning mechanism 25. Manipulator mechanism 27 causes manipulating arm 101 to be extended forward by shaft 121, raised by shaft 139, and moved adjacent units 22 by extension of shaft 145. Fingers 153 engage net 23 after being exposed by retraction of shaft 109, and wrapping assembly 33 is rotating about units 22 thereby beginning a stretched wrap of net 23, from continuous supply 43, around the units. Forming and positioning mechanism 25 forms and dispenses a quantity of engaging member 24 for positioning against units 22 so that body portion 157 is adjacent the units and net engaging projections 163 are extending angularly away from the units in opposed directions from each side of body portion 157.

Figure 19B:
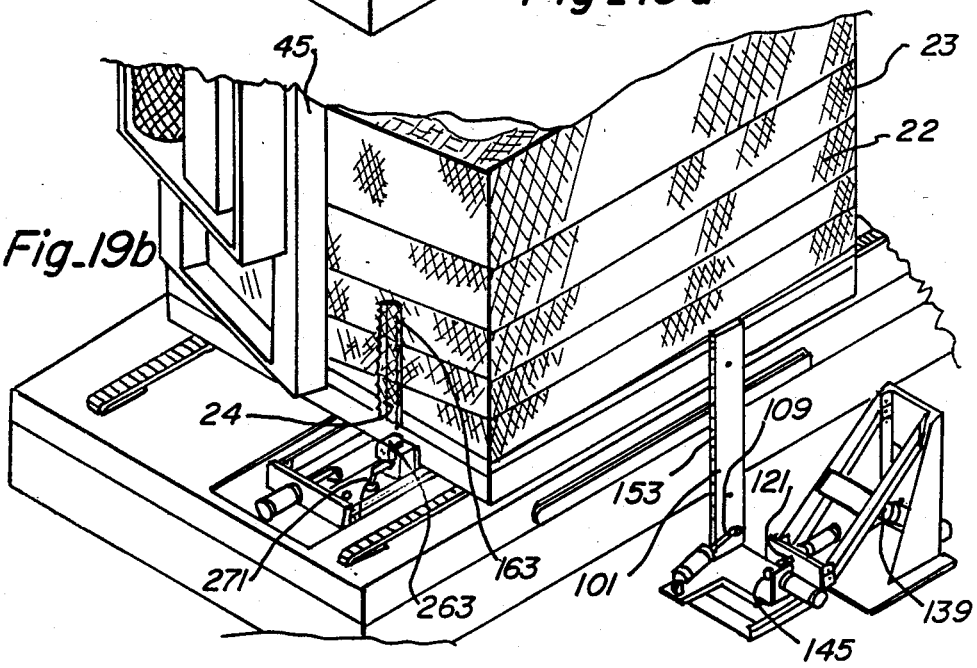

In FIG. 19*b* a plurality of wraps of net 23 are shown, some of which overlap projections 163 and are engaged thereby. Extension of shaft 271 extends cutting blade 263 for severing engaging member 24. Fingers 153 are retracted by extension of shaft 109 whereupon retraction of shafts 139 and 121 cause arm 101 to move down and rearward thereby moving free of net 23. Shaft 145 then may move arm 101 away from units 22. Positioning apparatus 45 wraps net 23 in a substantially even distribution vertically around units 22.

Figure 19C:
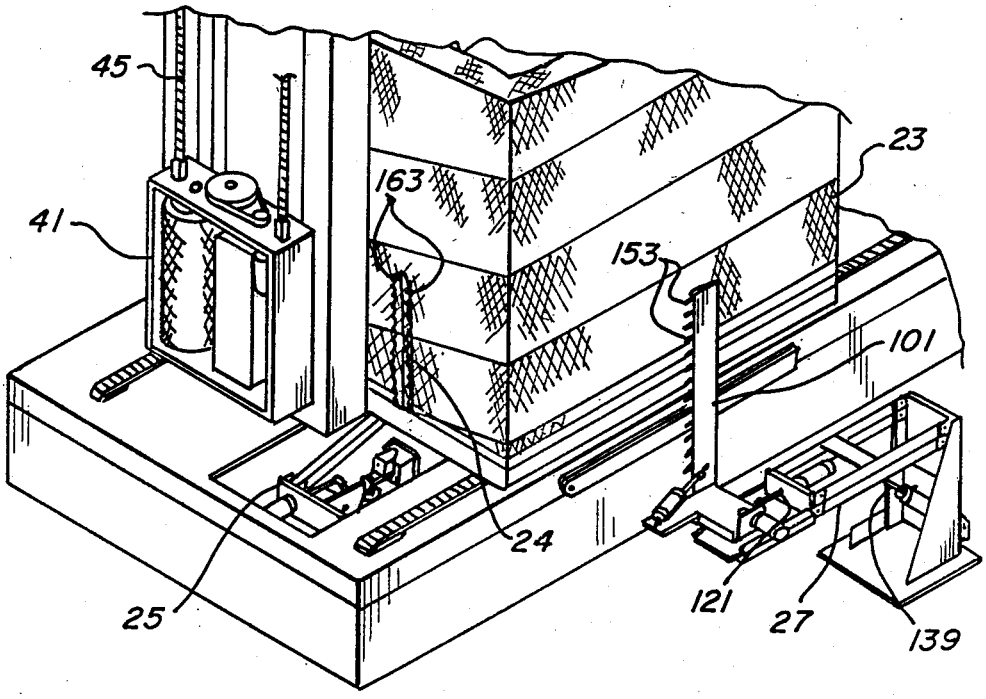

FIG. 19*c* illustrates positioning apparatus 45 again moving dispenser mechanism 41 downward so that final wraps of net 23 overlap engaging member 24 for engagement of the net with projections 163. Fingers 153 of manipulator mechanism 27 are extended from arm 101 and shafts 139 and 121 are extended thereby raising and moving forward arm 101. Forming and positioning mechanism 25 is lowered by retraction of shaft 245 (shown in FIG. 12).

Figure 19D:
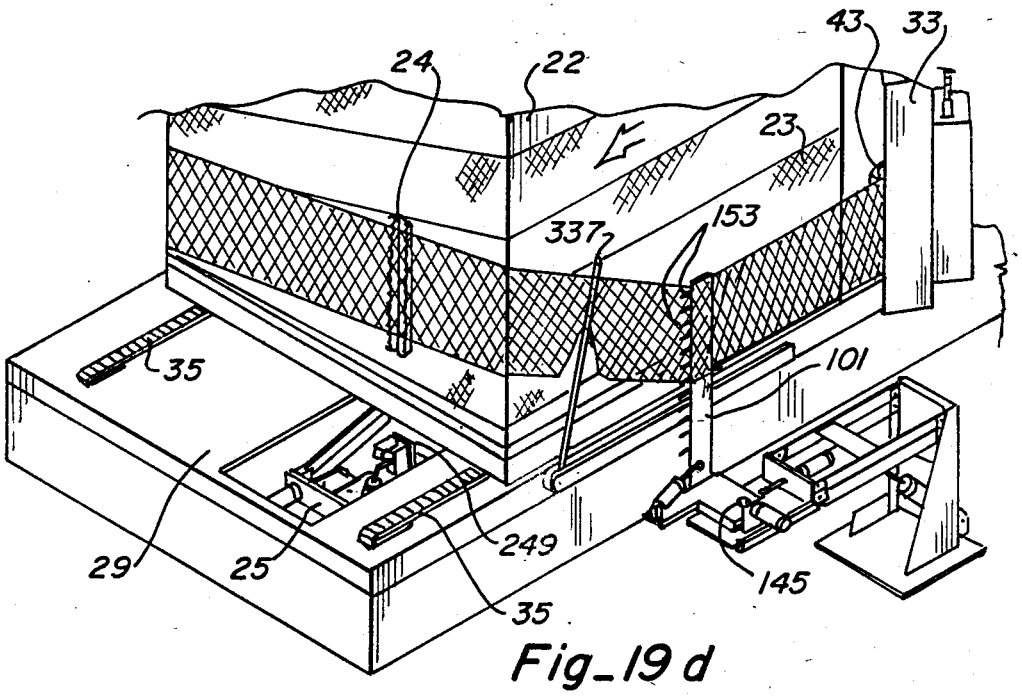

FIG. 19*d* shows wrapping assembly 33 again at its home position. Net 23, having again been engaged by fingers 153, is severed by severing rod 337 from supply 43, engaging member 24 retaining net 23 stretched around units 22. Forming and positioning mechanism 25 is completely lowered below receiving area 29 thereby allowing wrapped and palletized units 22 to be moved from receiving area 29 by tracks 35, whereinafter extension of shaft 245 (shown in FIG. 12) will position mechanism 25, and so positioning element 249, for receipt of another unwrapped pallet of units. Arm 101, having net 23 still engaged by fingers 153, may then be moved adjacent units 22 by extension of shaft 145 and the process repeated.

FIG. 20 illustrates a pneumatic flow control arrangement suitable for application of positive air pressure to operational cylinders 87, 97, 117, 127, 241, 267 and 281 from a plant air supply (for example, an 80 PSI plant supply). Solenoid pairs 337 and 337' through 343 and 343' control the passage of air through valves 345 through 351, respectively, in response to appropriate signals from control unit 30 (as illustrated in FIG. 21) for application of positive air pressure through lines 353 and/or 353' through 359 and/or 359', respectively, to the operational cylinders to thereby cause cylinder shafts 109, 121, 139, 145, 245, 271 and 281 to properly position the various operational elements (or, in the case of cylinder 281 and shaft 285, to dispense engaging member 24 by reciprocal movement of shaft 285 caused by alternating the supply of air to each side of cylinder 281 through lines 355 and 355').

FIG. 21 illustrates the flow sequence steps preferred under the control of the controller (i.e. through software programming as is well known). Other known means for sequential control of the device to perform the operational steps, as needed or desired, can also be utilized.

As shown in FIG. 21, the flow sequence steps are controlled by the controller with automatic stop and alarm systems being utilized in the event of improper performance. As illustrated in FIG. 1, the stop and alarm systems are caused to operate when failure to complete a step is sensed, or by input of an emergency stop order by an operator of apparatus and mechanism 20 and 21. The operator may then correct the cause of a breakdown and either start the process at the uncompleted stage of the wrapping process or reinitialize the wrapping process by selecting the restart option, in appropriate circumstances. While only a single embodiment of the invention is shown herein, it is to be realized that various modifications could be made thereto, as would be obvious to one skilled in the art, without departing from the scope of the invention.

As may be appreciated from the foregoing, an improved material positioning and securing apparatus has been shown which utilizes an improved material securing and engaging member, and includes a device for forming the material engaging member from a continuous supply of stock material and then positioning the thus formed engaging member, and a device for manipulating the material so that a net of stretchable material is positioned and secured around palletized units.

What is claimed is:

1. A material engaging and securing device for securing material wrapped around a structure, device comprising a plurality of interconnected engaging means positionable adjacent to said structure, with at least some of said engaging means extending away from said structure and with said engaging means including place maintaining means to secure the position of said material engaging and securing device relative to a position adjacent to said structure, whereby said material is engaged by said at least some of said engaging, means and secured around said structure.

2. The device of claim 1 wherein some of said least a first direction and others of said engaging means extend away from said structure in at least a second direction, with each of said directions having a common directional component.

3. The device of claim 2 wherein said plurality of interconnected engaging means are interconnected so that first and second substantially parallel rows of engagement means are formed, with said first row of said engaging means extending away from said structure in said first direction and with said second of said engaging means extending away from said structure in said second direction.

4. The device of claim 3 wherein said first and second rows of engaging means are interconnected at a body portion positioned between said first and second rows of said engagement means.

5. The device of claim 4 wherein said body portion is an elongate strip of material positionable adjacent to said structure, said elongate strip of material having elongate edges, and with said first and second rows of engaging means positioned adjacent said elongate edges.

6. The device of claim 5 wherein laid engaging means include a plurality of fingers.

7. The device of claim 2 wherein said material engaging and securing device is made of a relatively stiff yet deformable material.

8. Fastening means for fastening material wrapped around a plurality of units to form a structure and having initial wraps preceding a final wrap around said plurality of units, said fastening means comprising a first portion positionable between said plurality of units and an initial wrap of said material, and a second portion connected with said first portion and having a plurality of engagement means configured so that at least some of said engagement means extend away from said plurality of units, said engagement means for engaging at least said final wrap of said material thereby maintaining said material around said plurality, of units.

9. The fastening means of claim 8 wherein said first portion is an elongate strip of material having elongate edges and wherein said second portion extends along substantially the entire length of each elongate edge of said first portion.

10. The fastening means of claim 9 wherein said material is netting and wherein said engagement means are fingers arranged coextensive with said each elongate edge and extending away therefrom for engaging said netting.

11. The fastening means of claim 10 wherein said fingers extend away from said plurality of units. thereby forming an acute angle with a portion of said plurality of units and an obtuse angle with said first portion.

12. The fastening means of claim 8 wherein said engagement means engage both an initial wrap and said final wrap thereby maintaining said material around said structure.

13. The fastening means of claim 8 wherein said fastening means is made of a relatively stiff yet deformable material.

14. A disposable net engaging and securing strip for engaging and securing a net material wrapped around a plurality of units to form a retainable, assemblage and having at least initial wraps preceding a final wrap around said plurality of units, said disposable net engaging and securing strip comprising:

a body portion having first, second, and third sections, said first section positionable between said plurality of units and an initial wrap of said net material and said second and third sections extending angularly away from said plurality of units in different directions said directions having a a plurality of net engaging, projections different ones of which are connected with said second and third sections of said body portion for material hereby securing said net material around said plurality of units.

15. The net engaging and securing strip of claim 14 wherein said first section of said body portion is an elongate strip of material having first and second elongate edges, and wherein said second section of said body portion is attached to said first elongate edge and wherein said third section of said body is attached to said second elongate edge.

16. The net engaging and securing strip of claim 15 wherein said plurality of net engaging projections are arranged in a spaced linear relationship along said second and third sections of said body portión.

17. The net engaging and securing strip of claim 14 wherein said plurality of net engaging projections extend away from said plurality of units so that an acute angle is formed with respect to a portion of said plurality of units and an obtuse angle is formed with respect to said first section of said body portion.

18. The net engaging and securing strip of claim 14 wherein said strip is made from a relatively stiff yet deformable material.

* * * * *

UNITED STATES PATENT AND TRADEMARK OFFICE

CERTIFICATE OF CORRECTION

PATENT NO. : 4,887,719

DATED : December 19, 1989

INVENTOR(S) : Kapke

It is certified that error appears in the above-identified patent and that said Letters Patent is hereby corrected as shown below:

Column 3, line 41, after "are" insert --partial perspective--.

Column 4, line 24, "a" should be --as--.

Column 5, line 66, "ma" should be --may--.

Column 10, line 19, after "said" insert --engaging means extend away from said structure in at--.

Column 10, line 29, after "second" insert --row--.

Column 10, line 42, "laid" should be --said--.

Column 11, line 23, after "a" insert --common directional component; and --.

Column 12, line 1, after "for" insert --engaging at least said final wrap of said net--.

UNITED STATES PATENT AND TRADEMARK OFFICE

CERTIFICATE OF CORRECTION

PATENT NO. : 4,887,719

DATED : December 19, 1989

INVENTOR(S) : Kapke

It is certified that error appears in the above-identified patent and that said Letters Patent is hereby corrected as shown below:

Column 12, line 1, "hereby" should be --thereby--.

Signed and Sealed this

Eleventh Day of June, 1991

*Attest:*

*Attesting Officer*

HARRY F. MANBECK, JR.

*Commissioner of Patents and Trademarks*